US008997355B2

(12) United States Patent
Sakamaki

(10) Patent No.: US 8,997,355 B2
(45) Date of Patent: Apr. 7, 2015

(54) TOOTHED PART MANUFACTURING METHOD, TOOTHED PART MANUFACTURING DEVICE, AND TOOTHED PART

(75) Inventor: Hiromu Sakamaki, Tahara (JP)

(73) Assignee: Aisin AW Co., Ltd., Anjo (JP)

( * ) Notice: Subject to any disclaimer, the term of this patent is extended or adjusted under 35 U.S.C. 154(b) by 454 days.

(21) Appl. No.: 13/365,725

(22) Filed: Feb. 3, 2012

(65) Prior Publication Data

US 2012/0216643 A1 Aug. 30, 2012

(30) Foreign Application Priority Data

Feb. 24, 2011 (JP) ..... 2011-038974

(51) Int. Cl.
*B21D 53/28* (2006.01)
*B21K 1/30* (2006.01)
*B23P 15/14* (2006.01)

(52) U.S. Cl.
CPC ..... *B21K 1/30* (2013.01)

(58) Field of Classification Search
CPC ..... B21J 13/02; B21J 5/02; B21K 1/30; B23P 15/14; F16H 55/17
USPC ..... 29/893.3, 893.33, 893.34, 893.36; 72/347, 352, 353.2, 353.6, 354.2, 72/370.1, 434, 469; 74/457
See application file for complete search history.

(56) References Cited

U.S. PATENT DOCUMENTS 3,069,756 A * 12/1962 Colestock ..... 29/893.36
3,298,219 A * 1/1967 Schober ..... 72/377
6,732,605 B2 5/2004 Takano et al.
7,827,692 B2 11/2010 Geiman
2006/0236541 A1* 10/2006 Prucher ..... 29/893.34
2007/0125148 A1* 6/2007 Dohmann et al. ..... 72/352
2010/0294064 A1 11/2010 Seko
2012/0216643 A1* 8/2012 Sakamaki ..... 74/434
2012/0216644 A1* 8/2012 Sakamaki et al. ..... 74/434

(Continued)

FOREIGN PATENT DOCUMENTS

JP A-57-177845 11/1982
JP 60018248 A * 1/1985 ..... B21K 1/30

(Continued)

OTHER PUBLICATIONS

May 1, 2012 International Search Report issued in International Patent Application No. PCT/JP2012/053129 (with translation).

(Continued)

*Primary Examiner* — Alexander P Taousakis
(74) *Attorney, Agent, or Firm* — Oliff PLC

(57) ABSTRACT

A method for manufacturing a toothed part from a cylindrical blank using a forming die. When forming a toothed portion on a radially outer section of the blank by applying a load in the axial direction of the blank to a radially center section of the blank while constraining a portion of an outer circumferential surface of the blank such that a constituent material of the blank flows radially outward, the constituent material of the blank at an intermediate section between the center section and the outer section flows in the axial direction toward a depressed portion of the forming die to form a projection portion. When the load is at maximum, a space is provided between the toothed portion and the forming die, and a space is provided between the projection portion and the forming die.

9 Claims, 10 Drawing Sheets

(56) References Cited

U.S. PATENT DOCUMENTS

| | | | | |
|---|---|---|---|---|
| 2012/0240405 | A1* | 9/2012 | Iwata et al. | 29/893.34 |
| 2013/0059166 | A1* | 3/2013 | Nagata et al. | 428/600 |
| 2013/0318792 | A1* | 12/2013 | Iwata et al. | 29/893.34 |

FOREIGN PATENT DOCUMENTS

| | | |
|---|---|---|
| JP | A-61-162236 | 7/1986 |
| JP | A-07-100578 | 4/1995 |
| JP | A-2000-140989 | 5/2000 |
| JP | A-2007-509761 | 4/2007 |
| JP | A-2008-036642 | 2/2008 |
| JP | A-2009-106953 | 5/2009 |

OTHER PUBLICATIONS

U.S. Appl. No. 13/365,831 in the name of Hiromu Sakamaki et al., filed Feb. 3, 2012.

Apr. 29, 2014 Restriction Requirement issued in U.S. Appl. No. 13/365,831.

Sep. 9, 2014 Notice of Allowance issued in U.S. Appl. No. 13/365,831.

May 1, 2012 International Search Report issued in International Patent Application No. PCT/JP2012/053133 (with translation).

* cited by examiner

TOOTHED PART MANUFACTURING METHOD, TOOTHED PART MANUFACTURING DEVICE, AND TOOTHED PART

INCORPORATION BY REFERENCE

The disclosure of Japanese Patent Application No. 2011-038974 filed on Feb. 24, 2011 including the specification, drawings and abstract is incorporated herein by reference in its entirety.

BACKGROUND OF THE INVENTION

The present invention relates to a toothed part manufacturing method for manufacturing, by forging, a toothed part that includes a toothed portion such as bevel gear portion, and also relates to a toothed part manufacturing device, and a toothed part.

DESCRIPTION OF THE RELATED ART

Toothed parts that include a toothed portion have been manufactured in the past by forging a blank. In such forging, a toothed part whose outer peripheral surface includes a toothed portion is manufactured by compressing a cylindrical blank from the axial direction of the blank to force the constituent material of the blank radially outward from the blank, and fill the inside of a forming die with the constituent material of the blank.

By thus compressing the blank from the axial direction of the blank, first, the constituent material of the blank fills an inner section of the forming die in the radial direction of the blank, after which the constituent material of the blank unidirectionally flows radially outward from the blank. Further compressing of the blank from the axial direction of the blank increases the surface pressure of a section of the forming die already filled with the constituent material of the blank, making it necessary to further increase the load (molding load) applied to the blank. The larger load applied to the forming die thus shortens the life of the forming die.

Japanese Patent Application Publication No. JP-A-57-177845 discloses art for forging. According to the art of JP-A-57-177845, a ring-shaped blank is subjected to pressure by a pressurizing mechanism from the axial direction while an outer circumferential surface of the ring-shaped blank is constrained, and the constituent material of the ring-shaped blank flows in the pressurizing direction to fill the inside of a tooth profile portion of a forming die. By using the pressurizing mechanism to apply pressure to the ring-shaped blank from the axial direction, some of the constituent material of the ring-shaped blank is pressed as excess material into an open space that is in communication with the tooth profile portion of the forming die. Thus, the constituent material of the ring-shaped blank flows under a constant pressure, which can reduce variations in product dimensions and precision that are caused by variations in the volume of the blank.

SUMMARY OF THE INVENTION

However, according to the art of JP-A-57-177845, after filling the inside of the tooth profile portion of the forming die with the constituent material of the ring-shaped blank, the ring-shaped blank is subjected to further pressure from the axial direction by the pressurizing mechanism, which increases the molding load. The larger load applied to the forming die thus shortens the life of the forming die.

The present invention was devised in order to solve the problem described above, and the present invention provides a toothed part manufacturing method, a toothed part manufacturing device, and a toothed part that can increase the life of a forming die.

An aspect of the present invention devised for solving the problem described above is a toothed part manufacturing method for manufacturing a toothed part from a cylindrical blank using a forming die. According to the toothed part manufacturing method, when forming a toothed portion on a radially outer section of the blank by applying a load in the axial direction of the blank to a radially center section of the blank while constraining a portion of an outer circumferential surface of the blank such that a constituent material of the blank flows radially outward, the constituent material of the blank at an intermediate section between the center section and the outer section flows in the axial direction toward a depressed portion of the forming die to form a projection portion. In addition, when the load is at maximum, a space is provided between the toothed portion and the forming die, and a space is provided between the projection portion and the forming die.

According to this aspect, the spaces are provided between the forming die and the blank so that the constituent material of the blank does not fully fill the forming die when the maximum molding load is applied in the axial direction of the blank to finish formation of the toothed portion. There is thus room left inside the spaces for the constituent material of the blank to flow. It is therefore possible to prevent the molding load from becoming excessively large as in enclosed die forging. Because the load on the forming die can be suppressed, the life of the forming die can be increased.

In addition, the constituent material of the blank flows in two directions, namely, a direction heading radially outward, and a direction heading toward the depressed portion of the forming die. Therefore, a reduction effect on the molding load can be obtained. Because the load on the forming die can be suppressed, the life of the forming die can be increased.

In the aspect described above, the depressed portion may have an outer shape that becomes smaller in the axial direction.

According to this aspect, it is thus difficult for the constituent material of the blank to flow toward the depressed portion of the tooth profile forming die. As a consequence, the blank does not fully fill the depressed portion of the forming die when formation of the toothed portion is finished, and the space between the blank and the forming die can be more easily provided. It is therefore possible to prevent the molding load from becoming excessively large regardless of the flowability of the constituent material of the blank. Moreover, because the load on the forming die can be suppressed regardless of the flowability of the constituent material of the blank, the life of the forming die can be increased.

In the aspect described above, as the forming die, a tooth profile forming die that forms the toothed portion on the outer section of the blank, an outer constraining die that constrains the outer circumferential surface of the blank, and an inner forming die that is provided inward of the outer constraining die may be used. Also, with the blank enclosed by the tooth profile forming die, the outer constraining die, and the inner forming die, the tooth profile forming die and the outer constraining die may be moved in sync in the axial direction relative to the inner forming die.

According to this aspect, teeth are formed from an inner side toward an outer side in the radial direction of the blank while expanding the tooth profile from the direction in which the tooth profile forming die is disposed, thereby forming the toothed portion on the radially outer side of the blank. Accordingly, the blank can be molded while leaving a space between the blank and the tooth profile forming die.

In the aspect described above, the toothed part may be a differential pinion gear used in a differential device.

According to this aspect, due to the increased life of the forming die used for manufacturing the differential pinion gear, mass production of the differential pinion gear at a lower manufacturing cost can be achieved.

Another aspect of the present invention devised for solving the problem described above is a toothed part manufacturing device for manufacturing a toothed part from a cylindrical blank using a forming die. According to the toothed part manufacturing device, when forming a toothed portion on a radially outer section of the blank by applying a load in the axial direction to a radially center section of the blank while constraining a portion of an outer circumferential surface of the blank such that a constituent material of the blank flows radially outward, the constituent material of the blank at an intermediate section between the center section and the outer section flows in the axial direction toward a depressed portion of the forming die to form a projection portion. In addition, when the load is at maximum, a space is provided between the toothed portion and the forming die, and a space is provided between the projection portion and the forming die.

According to this aspect, the spaces are provided between the blank and the forming die so that the constituent material of the blank does not fully fill the forming die when the maximum molding load is applied in the axial direction of the blank to finish formation of the toothed portion. There is thus room left inside the spaces for the constituent material of the blank to flow. It is therefore possible to prevent the molding load from becoming excessively large as in enclosed die forging. Because the load on the forming die can be suppressed, the life of the forming die can be increased.

Another aspect of the present invention devised for solving the problem described above is a toothed part manufactured from a cylindrical blank using a forming die. According to the toothed part, when forming a toothed portion on a radially outer section of the blank by applying a load in the axial direction to a radially center section of the blank while constraining a portion of an outer circumferential surface of the blank such that a constituent material of the blank flows radially outward, the constituent material of the blank at an intermediate section between the center section and the outer section flows in the axial direction toward a depressed portion of the forming die to form a projection portion; and when the load is at maximum, a space is provided between the toothed portion and the forming die, and a space is provided between the projection portion and the forming die, thereby manufacturing the toothed part. In addition, the projection portion is formed so as to protrude in the axial direction radially inward of the toothed portion.

According to this aspect, the spaces are provided between the blank and the forming die so that the constituent material of the blank does not fully fill the forming die when the maximum molding load is applied in the axial direction of the blank to finish formation of the toothed portion. There is thus room left inside the spaces for the constituent material of the blank to flow. It is therefore possible to prevent the molding load from becoming excessively large as in enclosed die forging. Because the load on the forming die can be suppressed, the life of the forming die can be increased.

In addition, because the projection portion formed by causing the constituent material to flow in the axial direction of the blank is provided radially inward with respect to the toothed portion (on an inner side of an inner-diameter end portion of the toothed portion), the projection portion has no effect on the functionality of the toothed part when the toothed part meshes with another toothed part at the toothed portion.

According to the toothed part manufacturing method, the toothed part manufacturing device, and the toothed part of the present invention, the life of the forming die can be increased.

DETAILED DESCRIPTION OF THE EMBODIMENT

A specific embodiment of the present invention will be described in detail with reference to the accompanying drawings. In the present embodiment, a differential pinion gear used in a differential device of a vehicle is described as an example of a toothed part. Note that the differential pinion gear of the differential device is a gear that is rotatably supported by a pinion shaft while meshed with a differential side gear inside a differential case.

Description of the Manufacturing Device

First, a toothed part manufacturing device 1 will be described. The manufacturing device 1 manufactures a differential pinion gear 12 (see FIG. 10) that includes a bevel gear portion 11 from a cylindrical blank 10 (see FIG. 1) by forging.

Figure 1:
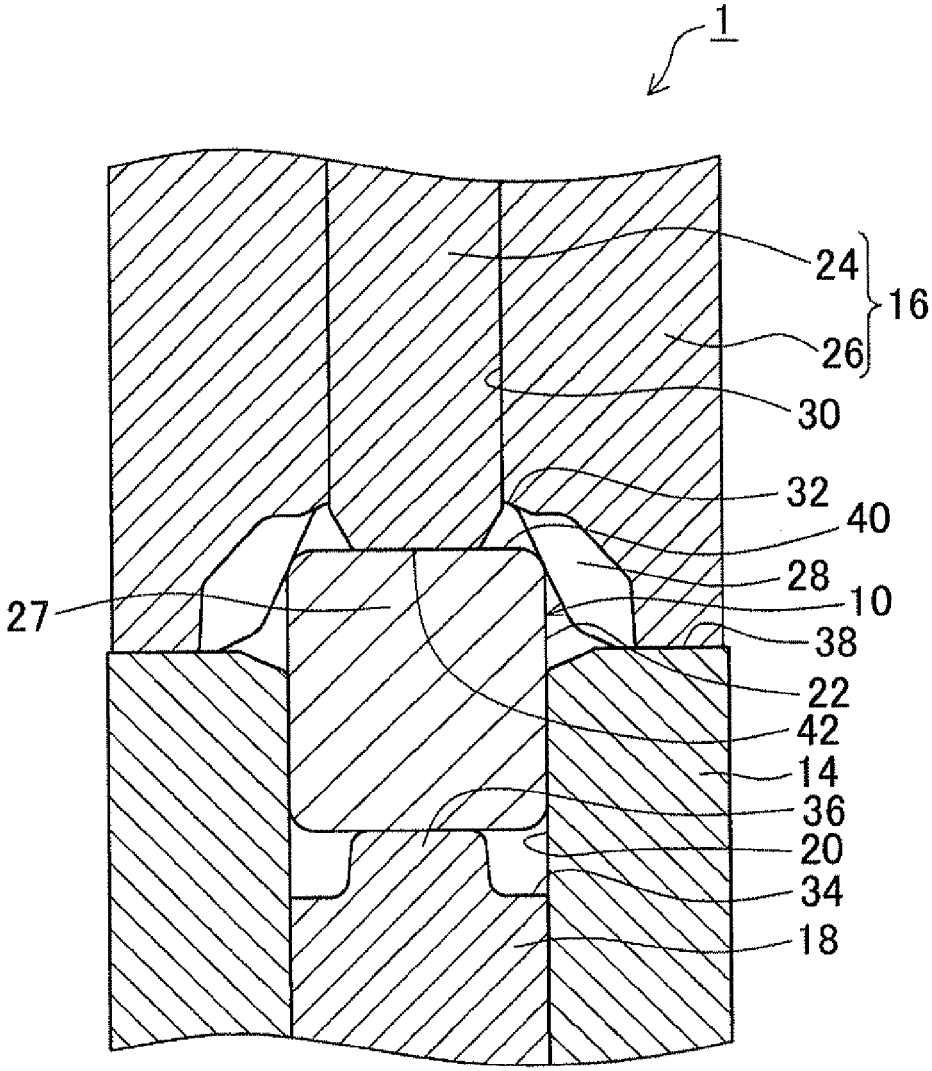
FIG. 1 is a structural diagram of an essential portion of a toothed part manufacturing device before molding of a blank.

As shown in FIG. 1, the manufacturing device 1 includes forming dies, namely, an outer constraining die 14, a tooth profile forming die 16, and an inner forming die 18. The manufacturing device 1 also includes an actuator (not shown) such as a hydraulic cylinder for operating each of the forming dies, and a control device (not shown) that controls the operation of the actuator. Note that FIG. 1 is a structural diagram of an essential portion of the manufacturing device 1 before molding of the blank 10.

The outer constraining die 14 is formed into a cylindrical shape and has an inner circumferential surface 20. The blank, 10 is disposed and the inner forming die 18 is also provided inward of the inner circumferential surface 20. The outer constraining die 14 is provided outward of an outer circumferential surface 22 of the blank 10, and constrains a portion of the outer circumferential surface 22 of the blank 10 during molding of the blank 10.

The tooth profile forming die 16 includes a compressing portion 24 and a tooth profile forming portion 26. The cylindrical tooth profile forming portion 26 is provided on the outer side of the cylindrical compressing portion 24. The compressing portion 24 is provided at a position that corresponds to a center section 27 of the blank 10 that is located at the radial center of the blank 10. The tooth profile forming portion 26 includes on a lower side thereof (side on which the outer constraining die 14 and the inner forming die 18 are provided) a tooth profile portion 28 that is formed into the shape of a bevel gear. Thus, as described later, the tooth profile forming portion 26 forms the bevel gear portion 11 on an outer section 43 of the blank 10 (see FIG. 9).

Figure 2:
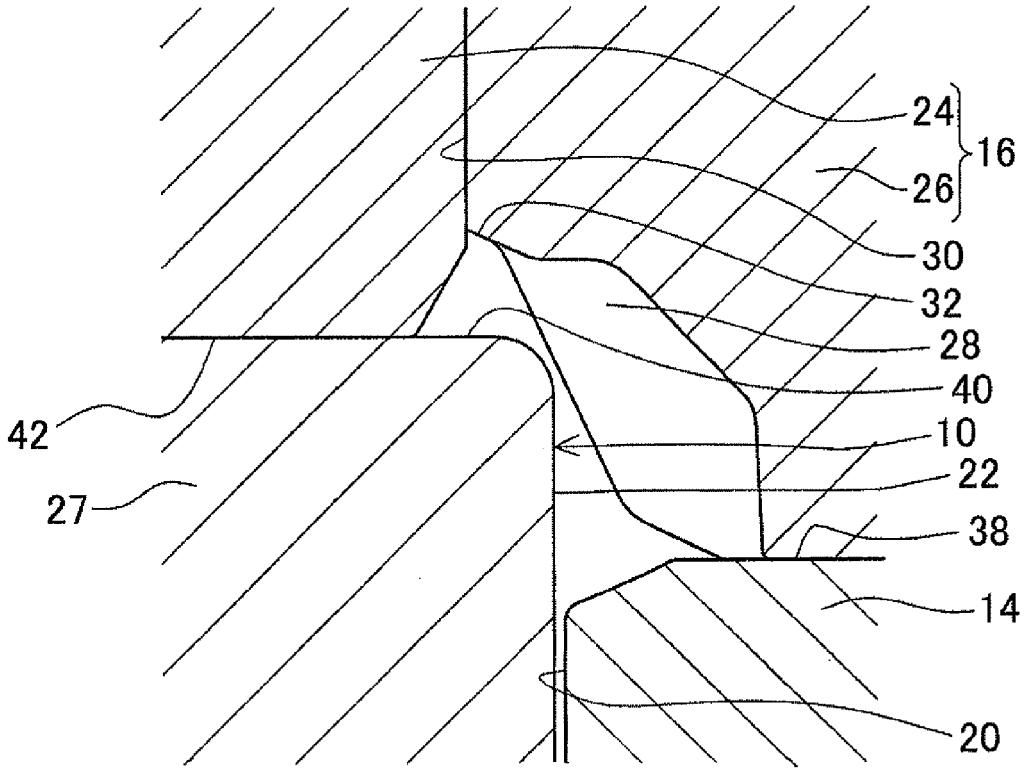
FIG. 2 is an enlarged view of a material clearance portion and a surrounding area in FIG. 1.

As shown in FIG. 2, the tooth profile forming portion 26 includes a material clearance portion 32 on the inner side of the tooth profile portion 28, that is, between the compressing portion 24 and the tooth profile portion 28 (between the tooth profile portion 28 and an inner circumferential surface 30 of the tooth profile forming portion 26). The material clearance portion 32 depresses upward (in a direction opposite from the direction in which the compressing portion 24 applies a load to the blank 10). The material clearance portion 32 has an outer shape formed into a configuration that tapers upward. In addition, the material clearance portion 32 is formed ring-like in the circumferential direction of the tooth profile forming portion 26 along the inner circumferential surface 30 of the tooth profile forming portion 26. Note that FIG. 2 is an enlarged view of the material clearance portion 32 and a surrounding area in FIG. 1. The material clearance portion 32 is an example of a "depressed portion" of the present invention.

The inner forming die 18 is formed into a cylindrical shape, and includes on an upper side thereof (side on which the tooth profile forming die 16 is provided) a projecting portion 36 on an end surface 34. The inner forming die 18 is provided inward of the inner circumferential surface 20 of the outer constraining die 14.

Description of the Manufacturing Method

Next, a method for manufacturing the differential pinion gear 12 using the thus configured manufacturing device 1 will be described.

First, as shown in FIG. 1, with the projecting portion 36 of the inner forming die 18 positioned lower than an end surface 38 on the upper side (side on which the tooth profile forming die 16 is provided) of the outer constraining die 14, the cylindrical blank 10 is disposed on the projecting portion 36 of the inner forming die 18 inward of the inner circumferential surface 20 of the outer constraining die 14. Next, the tooth profile forming die 16 is disposed by disposing the tooth profile forming portion 26 on the end surface 38 of the outer constraining die 14, and disposing the compressing portion 24 on an end surface 40 on the upper side (side where the tooth profile forming die 16 is provided) of the blank 10. Thus, the blank 10 is disposed inside a space enclosed by the forming dies, i.e., the outer constraining die 14, the tooth profile forming die 16, and the inner forming die 18. At such time, the blank 10 is interposed between the projecting portion 36 of the inner forming die 18 and an end surface 42 of the compressing portion 24, and a portion of the outer circumferential surface 22 is constrained by the outer constraining die 14.

Figure 3:
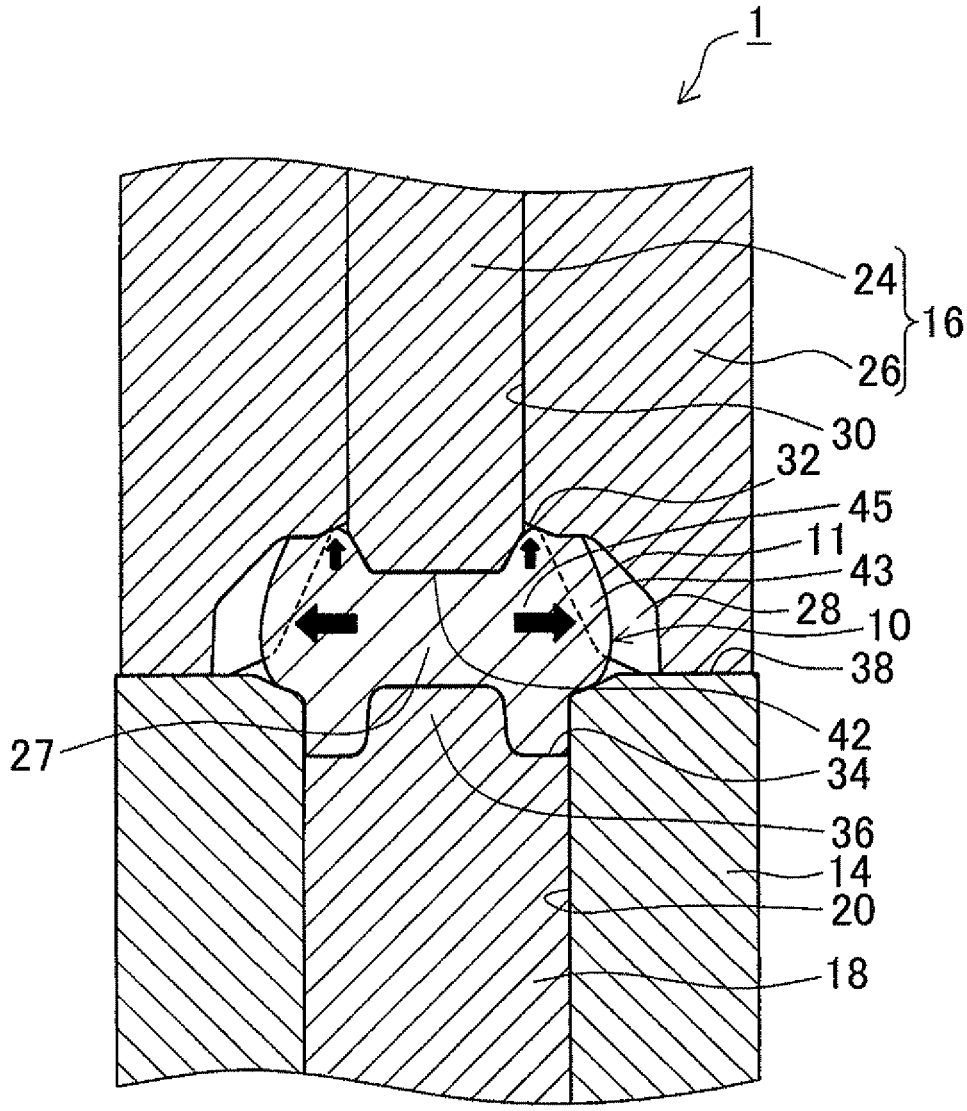
FIG. 3 is a structural diagram of the essential portion of the toothed part manufacturing device during molding of the blank.

Next, as shown in FIG. 3, the outer constraining die 14 and the tooth profile forming die 16 move as one (in sync) downward relative to the inner forming die 18 (in the direction where the inner forming die 18 is provided). At such time, the compressing portion 24 of the tooth profile forming die 16 applies a downward load to the center section 27 of the blank 10 and compresses the center section 27, whereby the constituent material of the blank 10 flows outward in the radial direction of the blank 10 (left-fight direction in FIG. 3). The area of the outer circumferential surface 22 of the blank 10 constrained by the outer constraining die 14 is reduced and teeth are consequently formed on the outer section 43 of the blank 10, thus forming the bevel gear portion 11.

Figure 4:
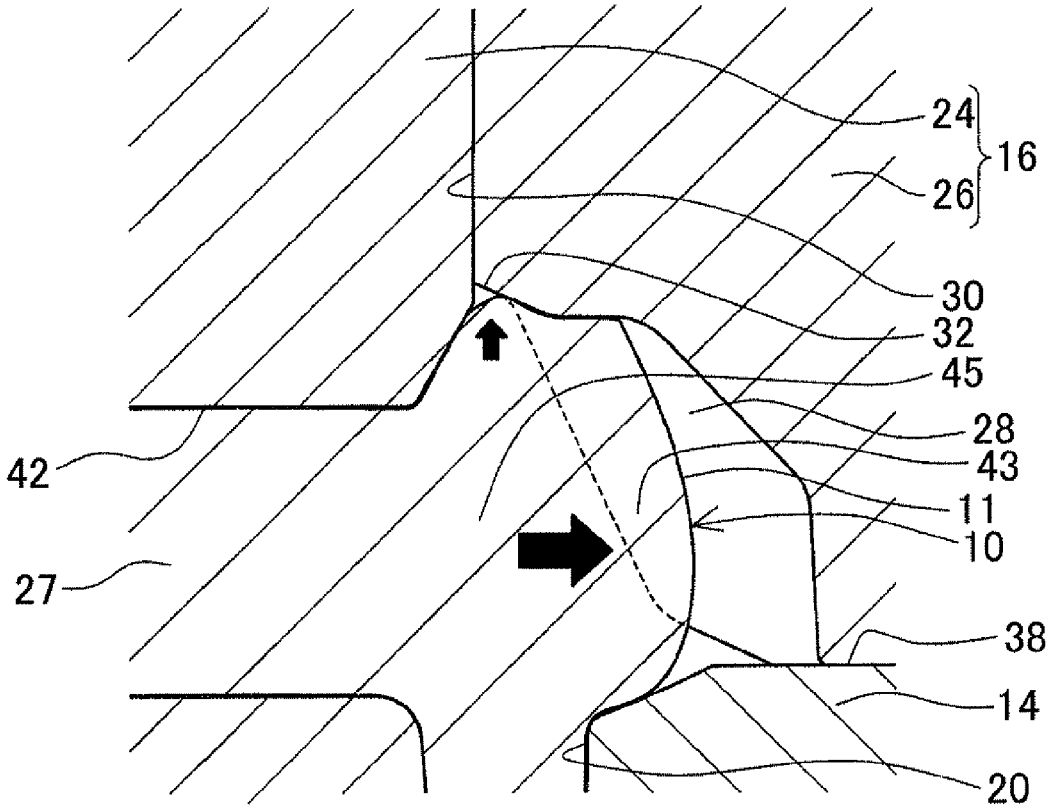
FIG. 4 is an enlarged view of the material clearance portion and the surrounding area in FIG. 3.
Figure 5:
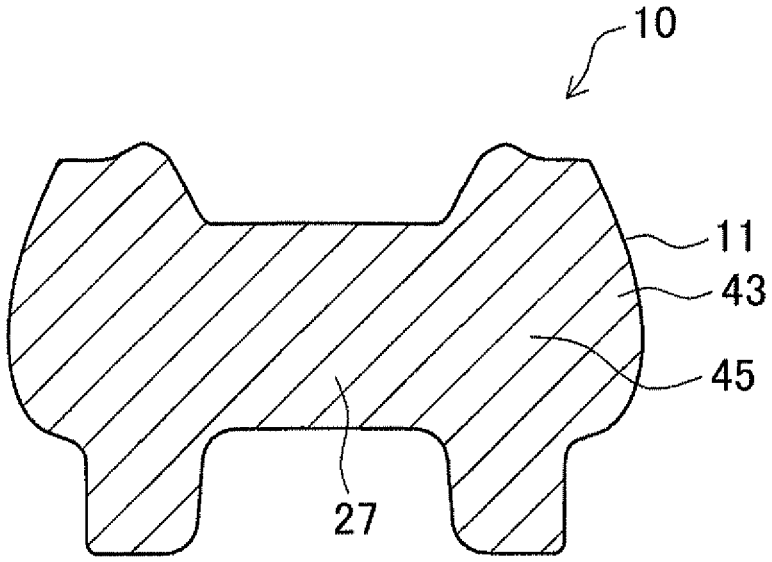
FIG. 5 is a cross-sectional view of the blank during molding.
Figure 6:
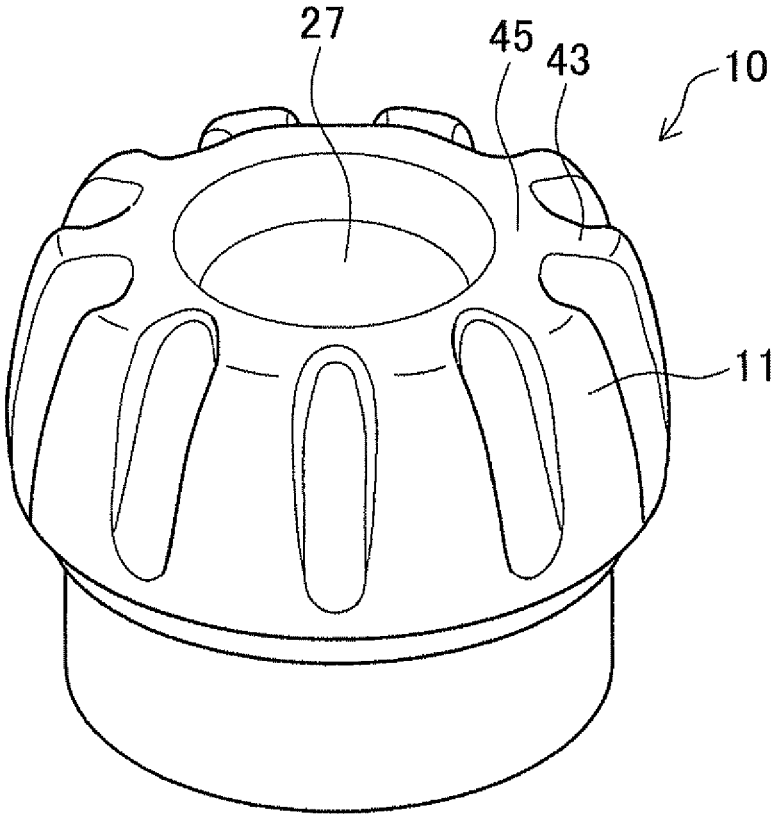
FIG. 6 is a perspective view of an outer appearance of the blank during molding.

At such time, as shown in FIG. 4, the constituent material of an intermediate section 45 of the blank 10 positioned between the center section 27 and the outer section 43 flows inside the material clearance portion 32, which causes the constituent material of the blank 10 to flow upward. More specifically, this causes the constituent material of the blank 10 to flow in a direction opposite from the direction in which the compressing portion 24 of the tooth profile forming die 16 applies a load to the center section 27 of the blank 10. Note that a space is left inside the material clearance portion 32, and that the inside of the material clearance portion 32 is not fully filled with the constituent material of the blank. At such time, the blank 10 takes on a form as shown in FIGS. 5 and 6.

Note that FIG. 3 is a structural diagram of the essential portion of the manufacturing device 1 during molding of the blank 10, and FIG. 4 is an enlarged view of the material clearance portion 32 and the surrounding area in FIG. 3. FIG. 5 is a cross-sectional view of the blank 10 during molding, and FIG. 6 is a perspective view of an outer appearance of the blank 10 during molding.

In this manner, during molding of the blank 10, the constituent material of the blank 10 flows and escapes into the material clearance portion 32. Therefore, the constituent material of the blank 10 flows in the axial direction (upward) in addition to the radial direction. Accordingly, the blank 10 can be molded while suppressing the molding load applied by the tooth profile forming die 16 to the blank 10. It is thus possible to suppress the load on the forming dies, i.e., the outer constraining die 14, the tooth profile forming die 16, and the inner forming die 18.

There is space remaining inside the material clearance portion 32 and the inside of the material clearance portion 32 is not fully filled with the constituent material of the blank. Therefore, even during subsequent molding of the blank 10, the constituent material of the blank 10 flows in the axial direction in addition to the radial direction. Thus, even during subsequent molding of the blank 10, the molding load applied by the tooth profile forming die 16 to the blank 10 can be suppressed, and the load applied to the forming dies, i.e., the outer constraining die 14, the tooth profile forming die 16, and the inner forming die 18, can be suppressed.

Figure 7:
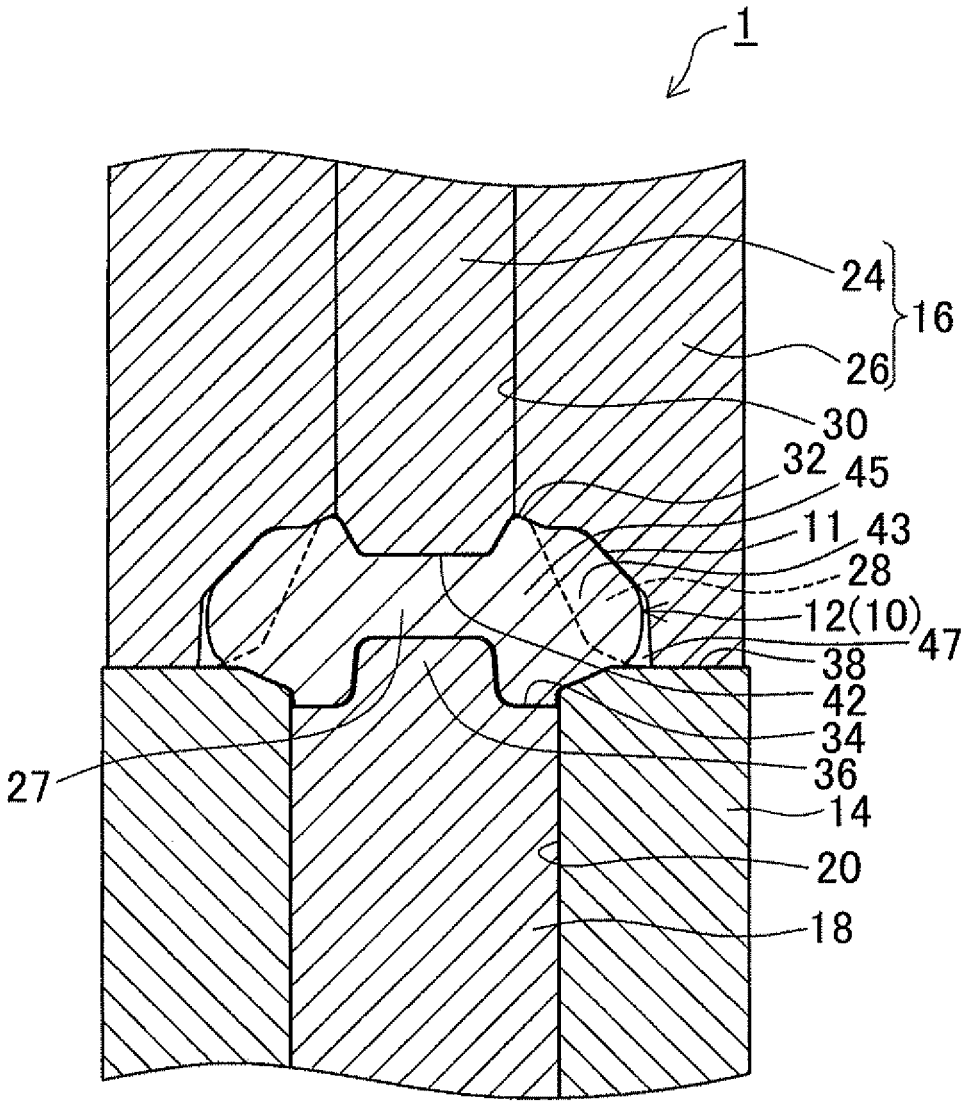
FIG. 7 is a structural diagram of the essential portion of the toothed part manufacturing device after molding of the blank is complete.
Figure 9:
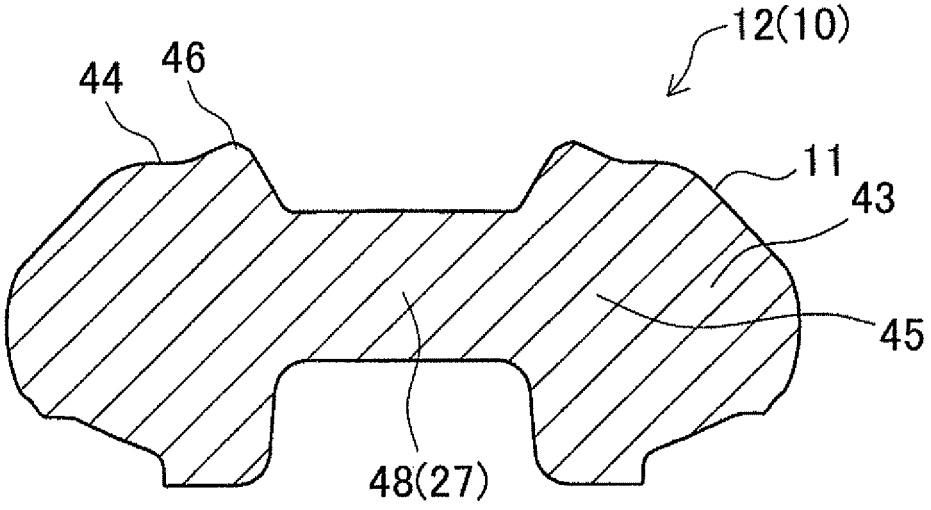
FIG. 9 is a cross-sectional view of a differential pinion gear.
Figure 10:
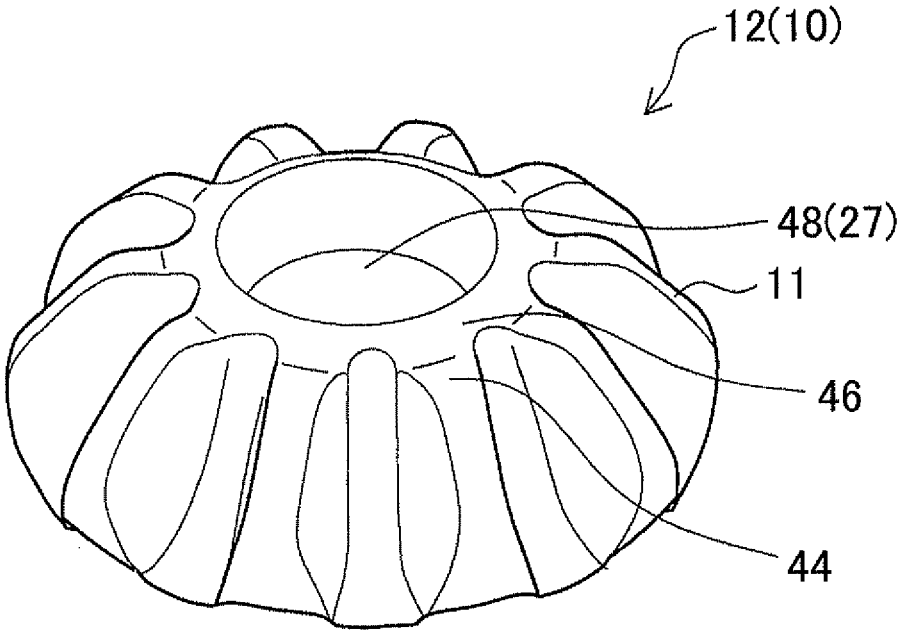
FIG. 10 is a perspective view of an outer appearance of the differential pinion gear.

Next, as shown in FIG. 7, when the outer constraining die 14 and the tooth profile forming die 16 further move as one downward relative to the inner forming die 18, the blank 10 is further compressed by the tooth profile forming die 16. The constituent material of the blank 10 thus flows further in the radial direction (left-right direction in FIG. 7) outward from the blank 10. The constituent material of the blank 10 then flows into the tooth profile portion 28 of the tooth profile forming die 16 to form a bevel gear on the outer section 43 of the blank 10, thereby completing molding of the blank 10. As shown in FIGS. 9 and 10, it is thus possible to manufacture the differential pinion gear 12 that includes the bevel gear portion 11 and is formed into a rotationally symmetrical shape.

Note that, to complete molding of the blank 10, the outer constraining die 14 and the tooth profile forming die 16 are moved to the most downward position and the largest molding load is applied. When molding of the blank 10 is complete, the differential pinion gear 12 (blank 10) is formed with a projection portion 46 that protrudes upward (in a direction opposite from the direction in which the compressing portion 24 of the tooth profile forming die 16 applies a load to the blank 10) from an inner end surface 44.

Figure 8:
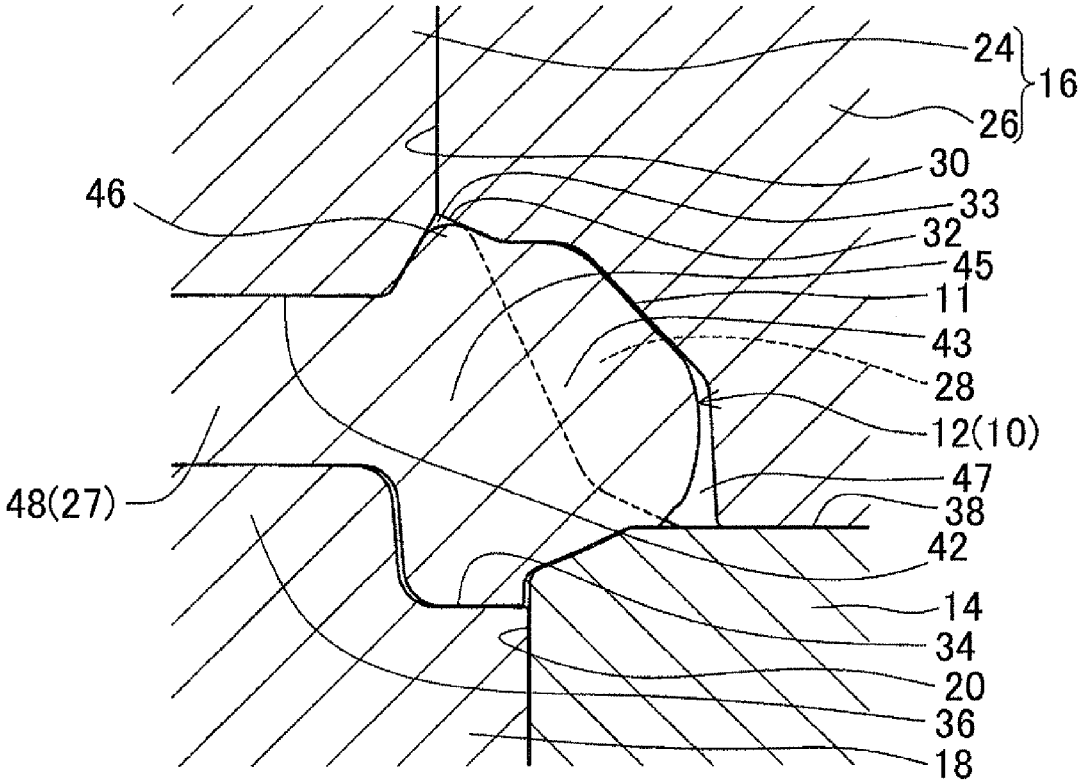
FIG. 8 is an enlarged view of the material clearance portion and the surrounding area in FIG. 7.

As shown in FIG. 8, when molding of the blank 10 is complete, the constituent material of the blank 10 does not fully fill the material clearance portion 32 of the tooth profile forming die 16, and a space 33 is provided between the projection portion 46 (the intermediate section 45 of the blank 10) and the tooth profile forming die 16. In addition, a space 47 is also provided between the bevel gear portion 11 and the tooth profile forming die 16. There is thus room left inside the spaces 33, 47 for the constituent material of the blank 10 to flow. It is therefore possible to prevent the molding load from becoming excessively large when molding of the blank 10 is complete.

As shown in FIGS. 9 and 10, the projection portion 46 is formed radially inward with respect to the bevel gear portion 11. Therefore, the projection portion 46 is formed on a section that does not interfere with a mating part (the differential sun gear) that meshes with the differential pinion gear 12, and the projection portion 46 has no effect on the functionality of the differential pinion gear 12 used in the differential device.

Note that FIG. 7 is a structural diagram of the essential portion of the manufacturing device 1 after molding of the blank 10 is complete, and FIG. 8 is an enlarged view of the material clearance portion 32 and the surrounding area in FIG. 7. FIG. 9 is a cross-sectional view of the differential pinion gear 12, and FIG. 10 is a perspective view of an outer appearance of the differential pinion gear 12.

Note that a center section 48 (see FIGS. 9 and 10) of the differential pinion gear 12 manufactured as described above undergoes additional processing such as boring in the axial direction (up-down direction in FIG. 9) to form an axial hole therein for accommodating the pinion shaft (not shown).

Description of Effects of the Embodiment

According to the present embodiment, the constituent material of the blank 10 does not fully fill the forming dies when the maximum molding load is applied in the axial direction of the blank 10 to finish formation of the bevel gear portion 11, and the spaces 33, 47 are provided between the bevel gear portion 11 and the tooth profile forming die 16 and between projection portion 46 (the intermediate section 45 of the blank 10) and the tooth profile forming die 16. There is thus room left inside the spaces 33, 47 for the constituent material of the blank 10 to flow. It is therefore possible to prevent the molding load from becoming excessively large as in enclosed die forging. Accordingly, because the load on the forming dies, i.e., the outer constraining die 14, the tooth profile forming die 16, and the inner forming die 18, can be suppressed, the life of the forming dies can be increased. Note that, an example of the results of a test evaluation showed an approximately 10% reduction in the molding load, which had the effect of increasing the life of the forming die by a factor of 1.2.

The outer shape of the material clearance portion 32 becomes smaller in the axial direction, which makes it difficult for the constituent material of the blank 10 to flow toward the material clearance portion 32. As a consequence, the blank 10 does not fully fill the material clearance portion 32 when formation of the bevel gear portion 11 is finished, and the space 33 between the blank 10 and the tooth profile forming die 16 can be more easily provided. It is therefore possible to prevent the molding load from becoming excessively large regardless of the flowability of the constituent material of the blank 10. Accordingly, because the load on the forming dies, i.e., the outer constraining die 14, the tooth profile forming die 16, and the inner forming die 18, can be suppressed regardless of the constituent material of the blank 10, the life of the forming dies can be increased.

In addition, because the outer constraining die 14 and the tooth profile forming die 16 are moved downward in sync, teeth are formed from an inner side toward an outer side in the radial direction of the blank 10 while expanding the tooth profile from the direction in which the tooth profile forming die 16 is disposed, thereby forming the bevel gear portion 11 on the outer section 43 of the blank 10. Therefore, the blank 10 can be molded while surely leaving the spaces 33, 47 between the bevel gear portion 11 and the tooth profile forming die 16 and between the projection portion 46 and the tooth profile forming die 16, respectively.

Due to the increased life of the forming dies used for manufacturing the differential pinion gear 12, mass production of the differential pinion gear 12 at a lower manufacturing cost can be achieved.

Note that the embodiment described above is only meant to illustrate an example and does not limit the present invention in any manner; various improvements and modifications are obviously possible without departing from the scope of the invention.

What is claimed is:

1. A toothed part manufacturing method for manufacturing a toothed part from a cylindrical blank using a forming die, wherein when forming a toothed portion on a radially outer section of the blank by applying a load in the axial direction of the blank to a radially center section of the blank while constraining a portion of an outer circumferential surface of the blank such that a constituent material of the blank flows radially outward, the constituent material of the blank at an intermediate section between the center section and the outer section flows in the axial direction toward a depressed portion of the forming die that is provided so as to be depressed toward opposite direction with respect to a direction in which the load is applied to form a projection portion while decreasing a constrained area of the outer circumferential surface, and when the load is at maximum, a space is provided between the toothed portion and the forming die, and a space is provided between the projection portion and the forming die.

2. The toothed part manufacturing method according to claim 1, wherein the depressed portion has an outer shape that becomes smaller in the axial direction.

3. The toothed part manufacturing method according to claim 1, wherein used as the forming die are a tooth profile forming die that forms the toothed portion on the outer section of the blank, an outer constraining die that constrains the outer circumferential surface of the blank, and an inner forming die that is provided inward of the outer constraining die, and with the blank enclosed by the tooth profile forming die, the outer constraining die, and the inner forming die, the tooth profile forming die and the outer constraining die are moved in sync in the axial direction relative to the inner forming die.

4. The toothed part manufacturing method according to claim 2, wherein used as the forming die are a tooth profile forming die that forms the toothed portion on the outer section of the blank, an outer constraining die that constrains the outer circumferential surface of the blank, and an inner forming die that is provided inward of the outer constraining die, and with the blank enclosed by the tooth profile forming die, the outer constraining die, and the inner forming die, the tooth profile forming die and the outer constraining die are moved in sync in the axial direction relative to the inner forming die.

5. The toothed part manufacturing method according to claim 1, wherein the toothed part is a differential pinion gear used in a differential device.

6. The toothed part manufacturing method according to claim 2, wherein the toothed part is a differential pinion gear used in a differential device.

7. The toothed part manufacturing method according to claim 3, wherein the toothed part is a differential pinion gear used in a differential device.

8. The toothed part manufacturing method according to claim 4, wherein the toothed part is a differential pinion gear used in a differential device.

9. A toothed part manufacturing device for manufacturing a toothed part from a cylindrical blank using a forming die, wherein when forming a toothed portion on a radially outer section of the blank by applying a load in the axial direction to a radially center section of the blank while constraining a portion of an outer circumferential surface of the blank such that a constituent material of the blank flows radially outward, the constituent material of the blank at an intermediate section between the center section and the outer section flows in the axial direction toward a depressed portion of the forming die that is provided so as to be depressed toward an opposite direction with respect to a direction in which the load is applied to form a projection portion while decreasing a constrained area of the outer circumferential surface, and when the load is at maximum, a space is provided between the toothed portion and the forming die, and a space is provided between the projection portion and the forming die.

* * * * *